US011220080B2

(12) United States Patent
Iwasa et al.

(10) Patent No.: US 11,220,080 B2
(45) Date of Patent: Jan. 11, 2022

(54) CARDBOARD BOX ERECTOR

(71) Applicant: ISHIDA CO., LTD., Kyoto (JP)

(72) Inventors: Tatsuya Iwasa, Ritto (JP); Atsushi Takahashi, Ritto (JP)

(73) Assignee: ISHIDA CO., LTD., Kyoto (JP)

( * ) Notice: Subject to any disclaimer, the term of this patent is extended or adjusted under 35 U.S.C. 154(b) by 114 days.

(21) Appl. No.: 16/712,996

(22) Filed: Dec. 13, 2019

(65) Prior Publication Data

US 2020/0254707 A1 Aug. 13, 2020

(30) Foreign Application Priority Data

Feb. 13, 2019 (JP) ..... JP2019-023643

(51) Int. Cl.
*B31B 50/26* (2017.01)

(52) U.S. Cl.
CPC ..... *B31B 50/262* (2017.08)

(58) Field of Classification Search
CPC ..... B65B 43/44; B65B 43/46; B65B 43/60; B65B 7/24; B65B 5/106; B65B 5/024; B65B 51/067; B65B 35/205; B31B 50/262; B31B 50/004; B31B 50/0042; B31B 50/0044; B31B 50/48; B31B 50/50; B31B 50/73; B31B 50/732; B31B 50/734
See application file for complete search history.

(56) References Cited

U.S. PATENT DOCUMENTS 2,419,991 A * 5/1947 Dunning ..... B65B 51/20 53/491
2,485,040 A * 10/1949 Cupo ..... B65B 51/20 53/53
2,496,336 A * 2/1950 Cupo ..... B65B 7/20 206/526
3,420,036 A * 1/1969 Hutchinson ..... B65B 43/305 53/566
5,063,726 A * 11/1991 Boisseau ..... B65B 7/20 53/491
5,102,382 A * 4/1992 Center ..... B31B 50/00 493/1
5,415,613 A * 5/1995 McGrath ..... B65D 5/10 493/137

(Continued)

FOREIGN PATENT DOCUMENTS

| | | | |
|---|---|---|---|
| FR | 2697497 | A1 | 5/1994 |
| GB | 324830 | A | 2/1930 |
| JP | 2012-162271 | A | 8/2012 |

OTHER PUBLICATIONS

Translation of Written Description of FR 2697497 A1.*
The Search Report from the corresponding European Patent Application No. 20157085.0 dated Jul. 14, 2020.

*Primary Examiner* — Thomas M Wittenschlaeger
(74) *Attorney, Agent, or Firm* — Shinjyu Global IP

(57) ABSTRACT

A cardboard box erector that folds four flaps provided on edges of an opening of a cardboard box so as to surround the opening is disclosed. The four flaps include a locking flap folded last among the four flaps. The cardboard box erector includes a folding unit configured to fold each of the four flaps in a predetermined order to close the opening, and a pushing unit configured to perform an action to push the locking flap inside the cardboard box and pull the locking flap back. The pushing unit has a suction unit configured to such and hold the locking flap.

5 Claims, 11 Drawing Sheets

(56) References Cited

U.S. PATENT DOCUMENTS

| | | | | | |
|---|---|---|---|---|---|
| 5,454,776 | A * | 10/1995 | Ulrich | B65B 7/20 | 493/117 |
| 6,070,396 | A * | 6/2000 | Rinaldi | B65B 7/20 | 493/23 |
| 8,128,547 | B2 * | 3/2012 | Graham | B31B 50/00 | 493/313 |
| 2021/0101354 | A1 * | 4/2021 | Iwasa | B31B 50/0044 | |

* cited by examiner

CARDBOARD BOX ERECTOR

CROSS-REFERENCE TO RELATED APPLICATIONS

This application claims priority to Japanese Patent Application No. 2019-23643, filed Feb. 13, 2019. The contents of that application are incorporated by reference herein in their entirety.

TECHNICAL FIELD

The present invention relates to a cardboard box erector.

BACKGROUND ART

In recent years, cardboard boxes with easily erectable bottoms have become common, and devices that erect such cardboard boxes have become widespread. For example, patent document 1 (JP-A No. 2012-162271) discloses a packaging box erector which, when erecting the bottom surface, first folds a first bottom flap, then folds a third bottom flap and a fourth bottom flap that are opposite each other, and lastly folds a second bottom flap that is opposite the first bottom flap, so that a tongue portion of the second bottom flap engages with the top of an engagement receiving portion of the first bottom flap, whereby the bottom surface of the packaging box is erected.

BRIEF SUMMARY

However, because the second bottom flap is pushed inside the packaging box to allow the tongue portion to engage with the top of the engagement receiving portion of the first bottom flap, in a case where the second bottom flap stays inside and does not come back, the work of flipping over the packaging box and pushing back the second bottom flap from inside becomes necessary.

It is an object of the present invention to provide a cardboard box erector that reduces a situation where a bottom flap it has pushed in last does not come back.

A cardboard box erector pertaining to a first aspect of the invention is a cardboard box erector that folds four flaps provided on edges of an opening of a cardboard box so as to surround the opening, the cardboard box erector having a folding unit and a pushing unit. The four flaps include a locking flap folded last among the four flaps. The folding unit folds each of the four flaps in a predetermined order to close the opening. The pushing unit performs an action to push the locking flap inside the cardboard box and pull the locking flap back. The pushing unit has a suction unit that sucks and holds the locking flap.

In this cardboard box erector, the locking flap is pushed deep inside past the open surface of the opening, but the suction unit that moves in conjunction with the pushing unit sucks and holds the locking flap, so when the pushing unit goes back, the suction unit can pull back the locking flap to the open surface.

A cardboard box erector pertaining to a second aspect of the invention is the cardboard box erector pertaining to the first aspect, wherein the pushing unit is secured to part of the folding unit.

In this cardboard box erector, it suffices for the pushing unit to start the pushing action from a predetermined position of the folding unit that is in a position near the locking flap, so the push stroke can be shortened.

A cardboard box erector pertaining to a third aspect of the invention is the cardboard box erector pertaining to the second aspect, wherein the four flaps include a set of small flaps that are opposite each other and a set of large flaps that are opposite each other, with one of the set of large flaps being the locking flap. The folding unit has a first folding unit, a second folding unit, and a third folding unit. The first folding unit folds the large flap that is opposite the locking flap out of the set of large flaps. The second folding unit folds the set of small flaps. The third folding unit folds the locking flap out of the set of large flaps. The pushing unit is secured to the third folding unit.

In this cardboard box erector, it suffices for the pushing unit to start the pushing action from a predetermined position of the third folding unit that folds the locking flap, so the push stroke can be shortened.

A cardboard box erector pertaining to a fourth aspect of the invention is the cardboard box erector pertaining to any one of the first aspect to the third aspect, wherein the suction unit allows the posture of its suction surface that sucks the locking flap to follow changes in the posture of the locking flap.

In this cardboard box erector, the locking flap that is pushed pivots about the edge of the opening as a central axis, so its posture changes in such a way that its angle of inclination increases in accordance with the distance it is pushed. The suction surface of the suction unit follows that change in posture, so it can maintain stable suction even when the locking flap inclines.

A cardboard box erector pertaining to a fifth aspect of the invention is the cardboard box erector pertaining to the fourth aspect, wherein the suction unit is pivotably retained by the pushing unit.

In this cardboard box erector, even when the locking flap is pushed and its angle of inclination increases, the suction surface follows the angle of inclination of the locking flap as a result of the suction unit pivoting.

In the cardboard box erector pertaining to the present invention, the locking flap is pushed deep inside past the open surface of the opening, but the suction unit that moves in conjunction with the pushing unit sucks and holds the locking flap, so when the pushing unit goes back, the suction unit can pull back the locking flap to the open surface.

DETAILED DESCRIPTION

An embodiment of the invention will be described below with reference to the drawings. The following embodiment is a specific example of the invention and is not intended to limit the technical scope of the invention.

(1) Configuration of Box Packing System 1

Figure 1:
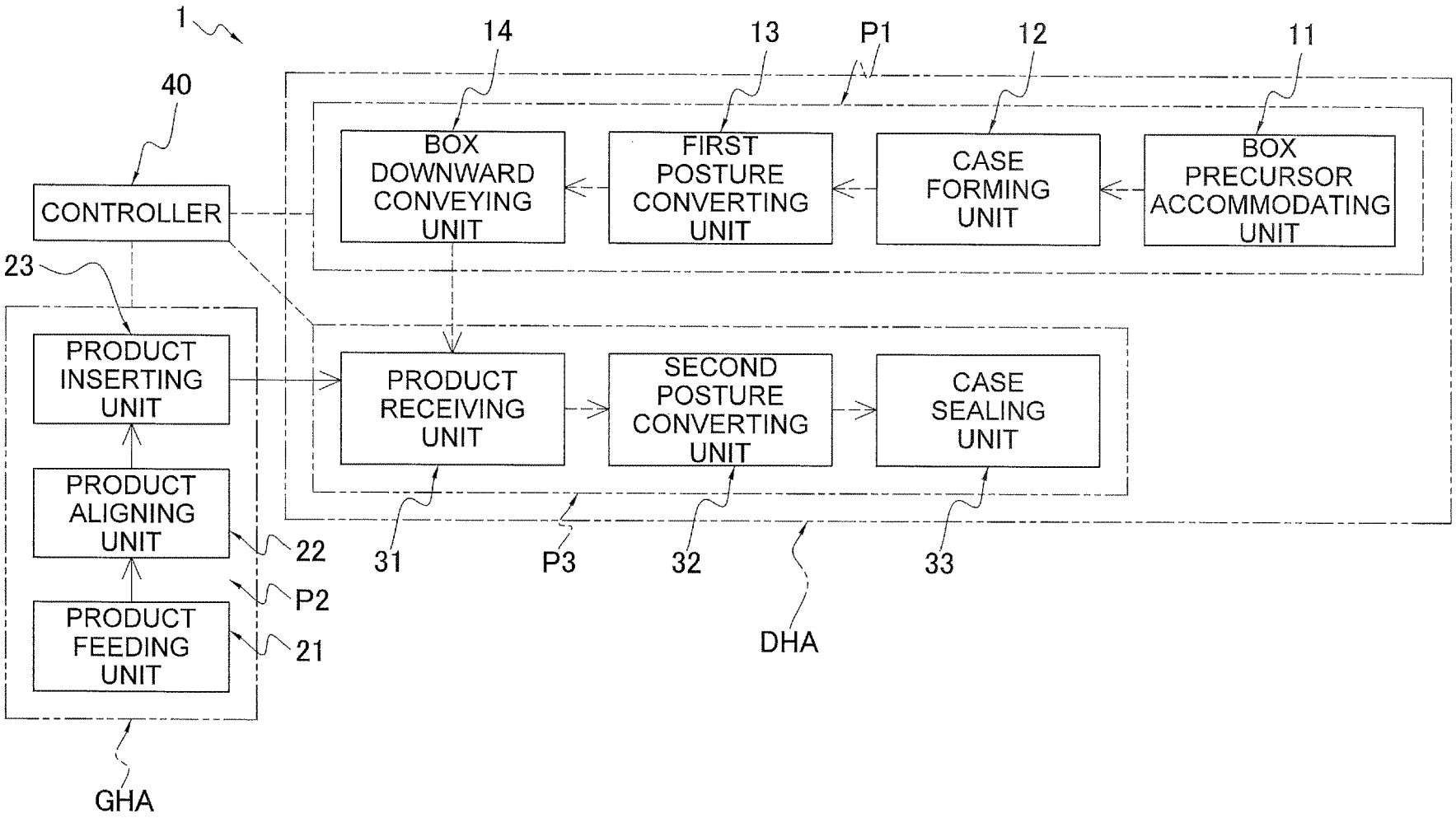
FIG. 1 is a block diagram of a box packing system equipped with a cardboard box erector pertaining to an embodiment of the invention.
Figure 2A:
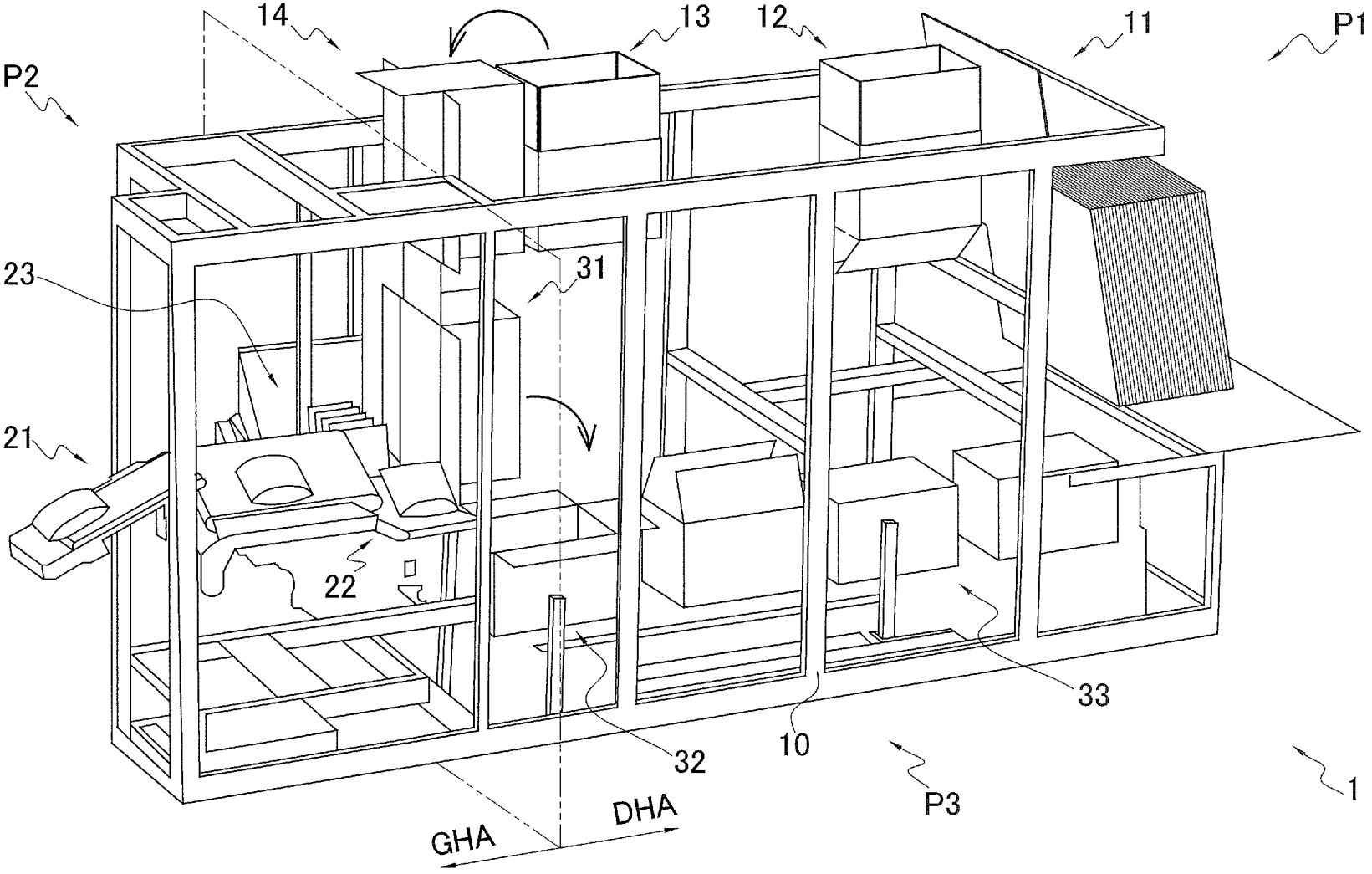
FIG. 2A is a perspective view showing the configuration of the box packing system.
Figure 2B:
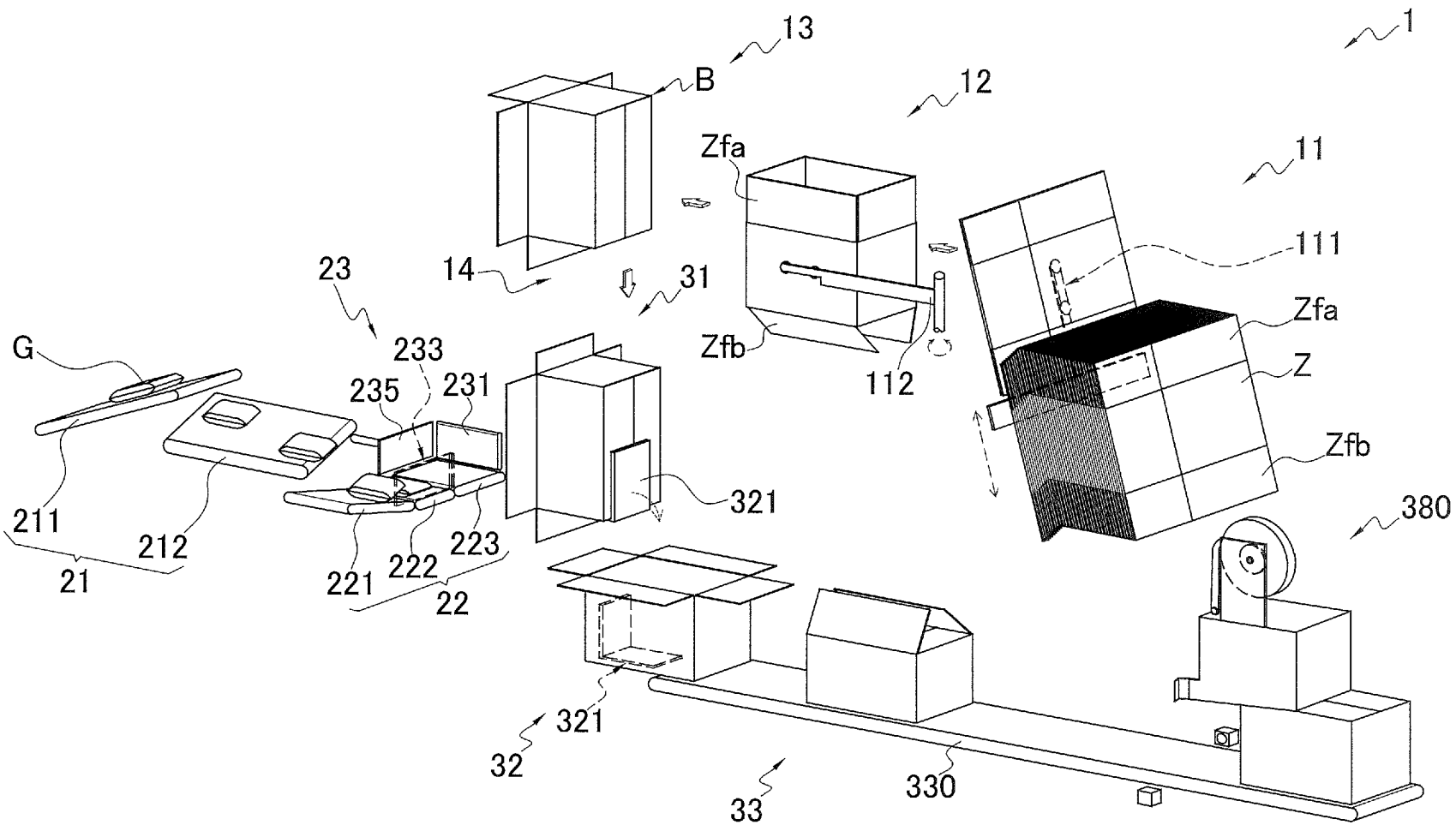
FIG. 2B is a perspective view showing a flow of cardboard boxes and products in the box packing system.

FIG. 1 is a block diagram of a box packing system 1 equipped with a cardboard box erector pertaining to an embodiment of the invention. FIG. 2A is a perspective view showing the configuration of the box packing system 1, and FIG. 2B is a perspective view showing a flow of cardboard boxes B and products G in the box packing system 1.

In FIG. 1 and FIG. 2A, the box packing system 1 packs a predetermined number of bagged products (products G), such as snack foods for example, in an aligned state and in multiple layers into cardboard boxes B.

As shown in FIG. 1 and FIG. 2A, the box packing system 1 comprises a cardboard box handling area DHA and a product handling area GHA that are interconnected in a state in which they are mutually independently separable. The cardboard box handling area DHA includes two processes, a case forming process P1 and a box packing process P3. The product handling area GHA includes a product aligning process P2.

That is, in the box packing system 1, the three processes of the case forming process P1, the product aligning process P2, and the box packing process P3 work together because the cardboard box handling area DHA and the product handling area GHA are interconnected.

The case forming process P1 is a process of erecting sheet-like cardboard box precursors Z into cardboard boxes B and conveying the cardboard boxes B to a box packing position. The case forming process P1 is configured by a box precursor accommodating unit 11, a case forming unit 12, a first posture converting unit 13, and a box downward conveying unit 14.

The product aligning process P2 is a process of feeding to a predetermined position the products G that are supplied from an upstream process, aligning a predetermined number of the products G so that adjacent products G partially lie on top of each other, and conveying the predetermined number of products G to the box packing position. The product aligning process P2 is configured by a product feeding unit 21, a product aligning unit 22, and a product inserting unit 23.

The box packing process P3 is a process of packing, into the cardboard boxes B that have been conveyed thereto from the case forming process P1, the predetermined quantity of the products G that have finished being aligned in the product aligning process P2, closing the boxes, and conveying the boxes to a box discharge position. The box packing process P3 is configured by a product receiving unit 31, a second posture converting unit 32, and a case sealing unit 33.

The box packing system 1 performs multilayer packing of the products G into the cardboard boxes B, and the posture of the products G inside the cardboard boxes B is a "standing posture." That is, the standing posture is a posture where, when the openings of the cardboard boxes B face up, the front sides and the back surfaces of the products G face sideways, the upper and lower end portions of the products G face up and down, and the left and right side portions of the products G face sideways.

As shown in FIG. 2A and FIG. 2B, the cardboard box handling area DHA has a two-level structure, and the case forming process P1 and the box packing process P3 are supported by a common frame 10. The case forming process P1 occupies the second-level portion, and the box packing process P3 occupies the first-level portion.

In order to realize this two-level structure, the conveyance direction of the cardboard boxes B from the erection of the cardboard boxes B by the case forming unit 12 to the box downward conveying unit 14 and the conveyance direction of the cardboard boxes B up to when the openings of the cardboard boxes B that have been packed with the products G are sealed by the case sealing unit 33 are mutually opposite directions.

(2) Case Forming Process P1

As shown in FIG. 2B, the case forming process P1 is configured by the box precursor accommodating unit 11 that introduces the cardboard box precursors Z to the box packing system 1, the case forming unit 12 that erects the cardboard boxes B, the first posture converting unit 13 that rotates the cardboard boxes B 90° about a horizontal axis orthogonal to the conveyance direction, and the box downward conveying unit 14 that conveys downward the cardboard boxes B that have been converted to a first posture.

(2-1) Box Precursor Accommodating Unit 11

The box precursor accommodating unit 11, as shown in FIG. 2B, picks one at a time and transports upward the cardboard box precursor Z at the very front of the cardboard box precursors Z stacked in a supply position and rotates the transported cardboard box precursor Z 90° about a vertical axis to thereby open it into a tubular shape.

The cardboard box precursors Z are placed in the supply position by a worker. The cardboard box precursors Z are collapsed with their flaps Zf open and are stacked in a horizontal direction in a posture in which the flaps Zf are positioned in the vertical direction. For convenience of description, the flaps Zf on the top surface side will be called top flaps Zfa and the flaps Zf on the bottom surface side will be called bottom flaps Zfb.

The upward transport of the cardboard box precursors Z is performed by a lift mechanism 111. When all the cardboard box precursors Z in the supply position run out, a detection sensor (not shown in the drawings) sends a detection signal to a controller 40 (see FIG. 1).

The rotation of the cardboard box precursors Z about the vertical axis is realized by sucking and holding, with suction cups, the side surfaces of the cardboard box precursors Z with a sucking and rotating mechanism 112 and rotating the sucking and rotating mechanism 112 90° about the vertical axis.

(2-2) Case Forming Unit 12

The case forming unit 12 conveys in a horizontal direction the cardboard box precursors Z that have been opened into a tubular shape and at the same time folds the bottom flaps Zfb of the cardboard box precursors Z to form bottoms, thereby erecting the cardboard boxes B which are in a state in which their top flaps Zfa are open.

The case forming unit 12 configures the cardboard box erector pertaining to this invention, and its details are described in "(5) Details of Case Forming Unit 12" below.

(2-3) First Posture Converting Unit 13

The first posture converting unit 13 rotates the cardboard boxes B 90° in the conveyance direction. More specifically, the first posture converting unit 13 rotates the cardboard boxes B 90° about a horizontal axis orthogonal to the conveyance direction to thereby convert the posture of the cardboard boxes B to a posture (hereinafter called a first posture) in which the openings and the top flaps Zfa of the cardboard boxes B lie in the same vertical plane. When the cardboard boxes B are in the first posture, their openings face the product handling area GHA.

(2-4) Box Downward Conveying Unit 14

The box downward conveying unit 14 conveys downward the cardboard boxes B that have been converted to the first posture. That is, the box downward conveying unit 14 moves the cardboard boxes B downward with the openings of the cardboard boxes B kept facing the product handling area GHA.

(3) Product Aligning Process P2

Disposed upstream of the product aligning process P2 in the flow of the products G in the box packing system 1 are a weigher and a bag-making and packaging machine and the like not shown in the drawings. Only products G that have passed weight, seal, and contamination inspections and the like in the upstream process are supplied to the product aligning process P2 in the box packing system 1.

The product aligning process P2 is configured by the product feeding unit 21 that receives the products G and conveys them to a predetermined position, the product aligning unit 22 that aligns the products G that are supplied from the product feeding unit 21, and the product inserting unit 23 that accumulates and pushes out the aligned products G.

(3-1) Product Feeding Unit 21

The product feeding unit 21 has a product introducing conveyor 211 and a feeding conveyor 212. The product introducing conveyor 211 receives, in a downstream of the process that performs the weight, seal, and contamination inspections and the like, the supply of the products G that have passed the inspections and leads those products G to the feeding conveyor 212.

The feeding conveyor 212 conveys to the product aligning unit 22 the products G conveyed thereto from the product introducing conveyor 211.

(3-2) Product Aligning Unit 22

The product aligning unit 22 has a first aligning conveyor 221, a second aligning conveyor 222, and a third aligning conveyor 223. The product aligning unit 22 conveys the products G to a predetermined position while performing an accumulating action with respect to the products G. The product aligning unit 22 is particularly suited for accumulating bag-like packages, so it can also be used independently as a package accumulating device.

(3-3) Product Inserting Unit 23

The product inserting unit 23 sandwiches the front and rear of the group of products G that have been aligned in a line by the third aligning conveyor 223 and inserts the whole group of products G into the cardboard boxes B. As shown in FIG. 2B, the product inserting unit 23 has a stand-up conveyor 231, a push plate 233, and an insertion plate 235 in order to sandwich the aligned group of products G.

(4) Box Packing Process P3

The box packing process P3 has the product receiving unit 31 that receives the products G into the cardboard boxes B, the second posture converting unit 32 that converts the posture of the cardboard boxes B so that the openings of the cardboard boxes B face up, and the case sealing unit 33 that conveys the cardboard boxes B that have finished being packed with the products G and at the same time closes the openings of the cardboard boxes B.

(4-1) Product Receiving Unit 31

The product receiving unit 31 maintains the cardboard boxes B in the first posture and has the cardboard boxes B stand by with their openings opposing the insertion plate 235 of the product inserting unit 23. An N-number of the products G that have been converted to the standing state in the product inserting unit 23 are pushed out by the insertion plate 235 toward the open surfaces of the cardboard boxes B, so the product receiving unit 31 stands by in that position until the N-number of the products G are completely inserted through the openings to the bottoms of the cardboard boxes B.

When a first layer of the N-number of the products G is inserted into a cardboard box B, the product receiving unit 31 descends a predetermined distance. Then, in order to receive a second layer of the N-number of the products G, the product receiving unit 31 has the cardboard box B stand by in such a way that the portion of the opening of the cardboard box B that leads to the space above the first layer opposes the insertion plate 235.

The product receiving unit 31 repeats the above actions so that an i-th layer of the N-number of the products G is inserted into the cardboard box B, and then the receiving of the products G into the cardboard box B is finished.

(4-2) Second Posture Converting Unit 32

As shown in FIG. 2B, the second posture converting unit 32 has a posture converting mechanism 321 that converts the posture of the cardboard boxes B packed with the products G to a posture in which the openings face up.

The posture converting mechanism 321 rotates the cardboard boxes B so that the open surfaces that had been vertical until then become horizontal, namely, so that the open surfaces face up. The posture converting mechanism 321 holds the cardboard boxes B with an L-shaped member having suction cups that simultaneously suck the side surfaces and the bottom surfaces of the cardboard boxes B, and when the L-shaped member rotates 90°, the cardboard boxes B rotate.

(4-3) Case Sealing Unit 33

As shown in FIG. 2B, the case sealing unit 33 has a discharge conveyor 330 that conveys the cardboard boxes B, a flap closing mechanism (not shown in the drawings) that closes the flaps surrounding the openings of the cardboard boxes B, and a tape applicator 380 that seals the openings that have been closed by the flaps.

(5) Details of Case Forming Unit 12

Here, the actions of folding the bottom flaps Zfb of the cardboard box precursor Z that has been opened into a tubular shape will be mainly described.

(5-1) Bottom Flaps Zfb of Cardboard Box B

Figure 3A:
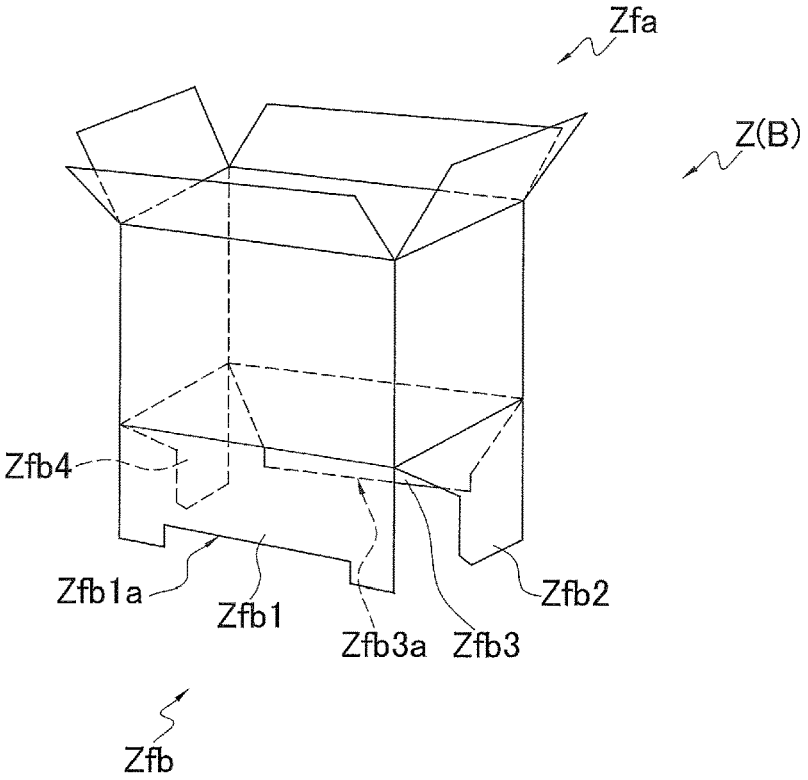
FIG. 3A is a perspective view of a cardboard box precursor that has been opened into a tubular shape before bottom flaps are folded.
Figure 3B:
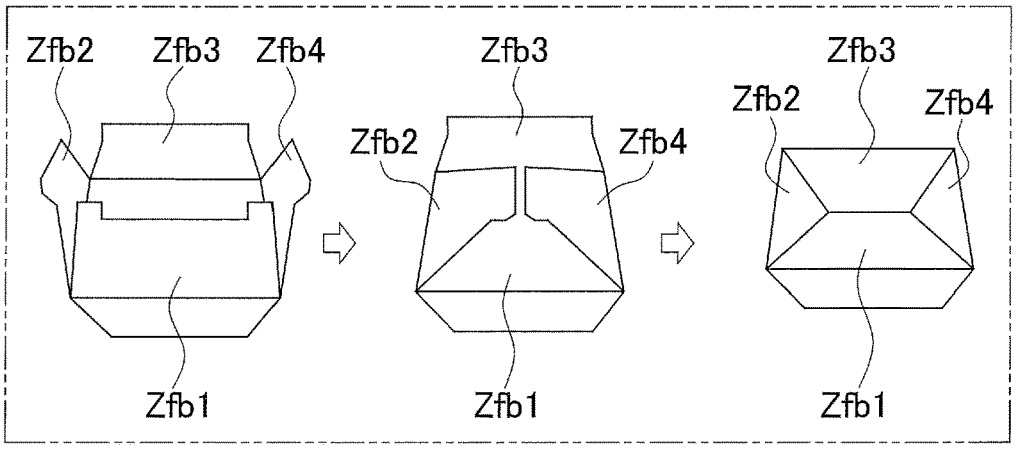
FIG. 3B is a perspective view showing, in three stages, a process of folding the bottom flaps shown in FIG. 3A.

First, before these actions are described, the cardboard box B handled by the box packing system 1 will be described. FIG. 3A is a perspective view of the cardboard box precursor Z that has been opened into a tubular shape before the bottom flaps Zfb are folded. FIG. 3B is a perspective view showing, in three stages, the process of folding the bottom flaps Zfb shown in FIG. 3A.

In FIG. 3A and FIG. 3B, the bottom flaps Zfb include a pair of large flaps Zfb1, Zfb3 that are opposite each other and a pair of small flaps Zfb2, Zfb4 that are opposite each other.

One large flap Zfb1 out of the pair of large flaps Zfb1, Zfb3 is provided with a recessed cutout Zfb1*a*, and the other large flap Zfb3 is provided with a tongue-like projecting piece Zfb3*a*. For convenience of description, the large flap Zfb1 having the recessed cutout Zfb1*a* will be called a preceding large flap Zfb1, and the large flap Zfb3 having the tongue-like projecting piece Zfb3*a* will be called a locking large flap Zfb3.

FIG. 3B is a perspective view showing the folding order of the bottom flaps Zfb in a cardboard box B whose bottom flaps Zfb are facing up. In FIG. 3B, first the preceding large flap Zfb1 is folded, then the pair of small flaps Zfb2, Zfb4 are folded, and lastly the locking large flap Zfb3 is folded. At this time, the locking large flap Zfb3 is pushed inside the cardboard box B so that the tongue-like projecting piece Zfb3*a* goes past the recessed cutout Zfb1*a* of the preceding large flap Zfb1, contacts the inside surface of the preceding large flap Zfb1, and stops. Because of this, the four bottom flaps Zfb interfere with each other and become locked.

In the case forming unit 12, this folding of the bottom flaps Zfb is performed automatically. The actions of folding the bottom flaps Zfb will be described below.

(5-2) Folding Mechanisms for Bottom Flaps Zfb

Figure 4:
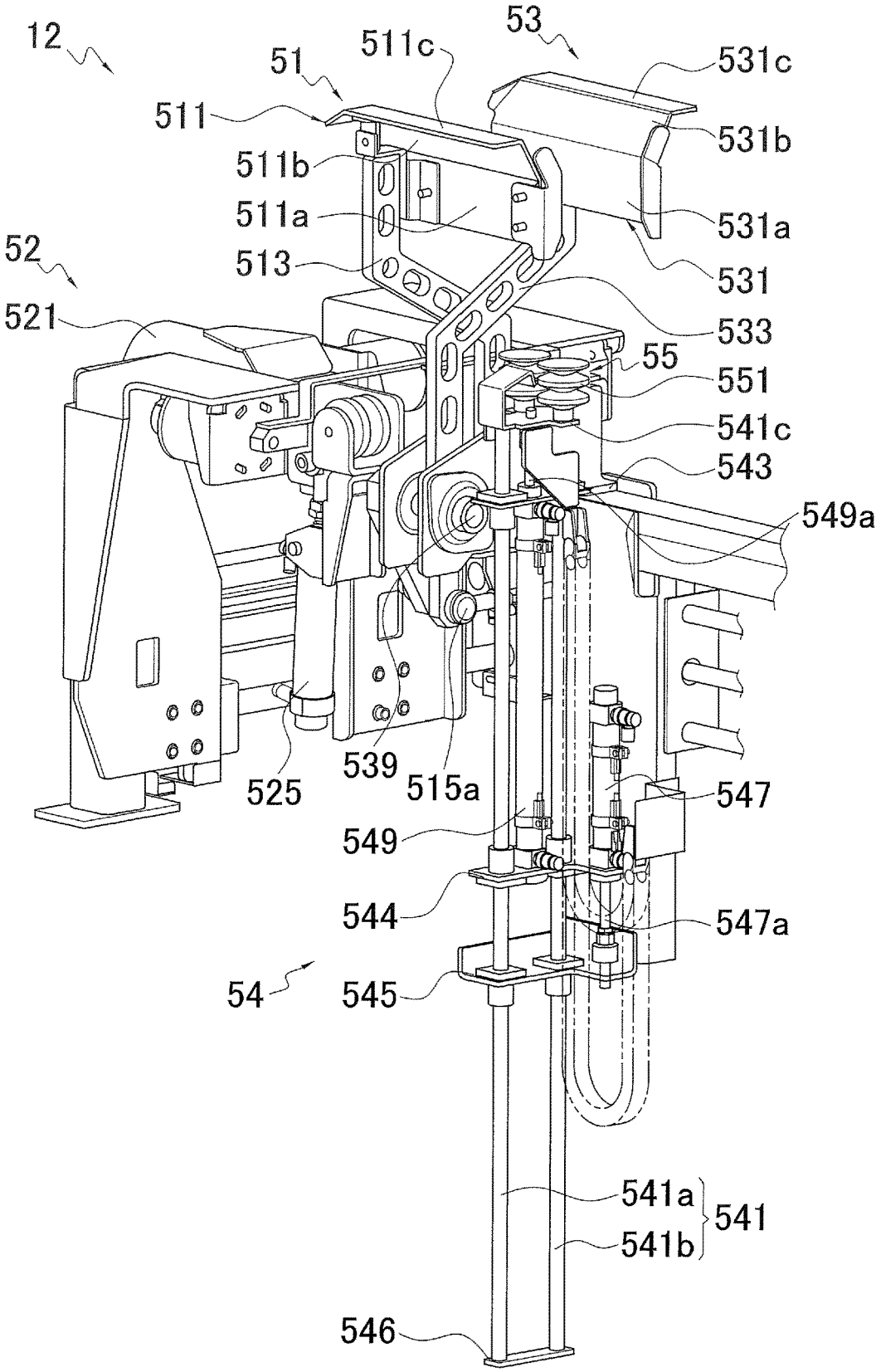
FIG. 4 is a perspective view of main portions of a case forming unit.

FIG. 4 is a perspective view of main portions of the case forming unit 12. In FIG. 4, the case forming unit 12 functioning as the cardboard box erector includes a first folding mechanism 51, a second folding mechanism 52, a third folding mechanism 53, a pushing mechanism 54, and a suction mechanism 55.

(5-2-1) First Folding Mechanism 51

The first folding mechanism 51 is a mechanism that folds the preceding large flap Zfb1 and includes a first folding plate 511, a first coupling bar 513, and a first air cylinder 515. In FIG. 4, the positional relationship between the first air cylinder 515 and the first folding plate 511 and first coupling bar 513 cannot be seen, so reference is to be made to FIG. 11, which shows a general side view of the first folding mechanism 51.

(5-2-1-1) First Folding Plate 511

The first folding plate 511 is a plate metal member having a first surface 511*a*, a second surface 511*b*, and a third surface 511*c*.

The second surface 511*b* extends so as to form an obtuse angle with respect to the first surface 511*a* from the end of the first surface 511*a*. The third surface 511*c* extends perpendicularly with respect to the first surface 511*a* from the end of the second surface 511*b*. Therefore, when the first surface 511*a* is horizontal, the third surface 511*c* is in a vertical posture, and when the first surface 511*a* is vertical, the third surface 511*c* is horizontal.

(5-2-1-2) First Coupling Bar 513

The first coupling bar 513 is a bar that transmits the displacement of a piston of the first air cylinder 515 to the first folding plate 511.

One end of the first coupling bar 513 is secured to the back surface of the first surface 511*a* of the first folding plate 511. The back surface of the first surface 511*a* is the surface on the opposite side of the surface that contacts the preceding large flap Zfb1 when folding the preceding large flap Zfb1.

Figure 11:
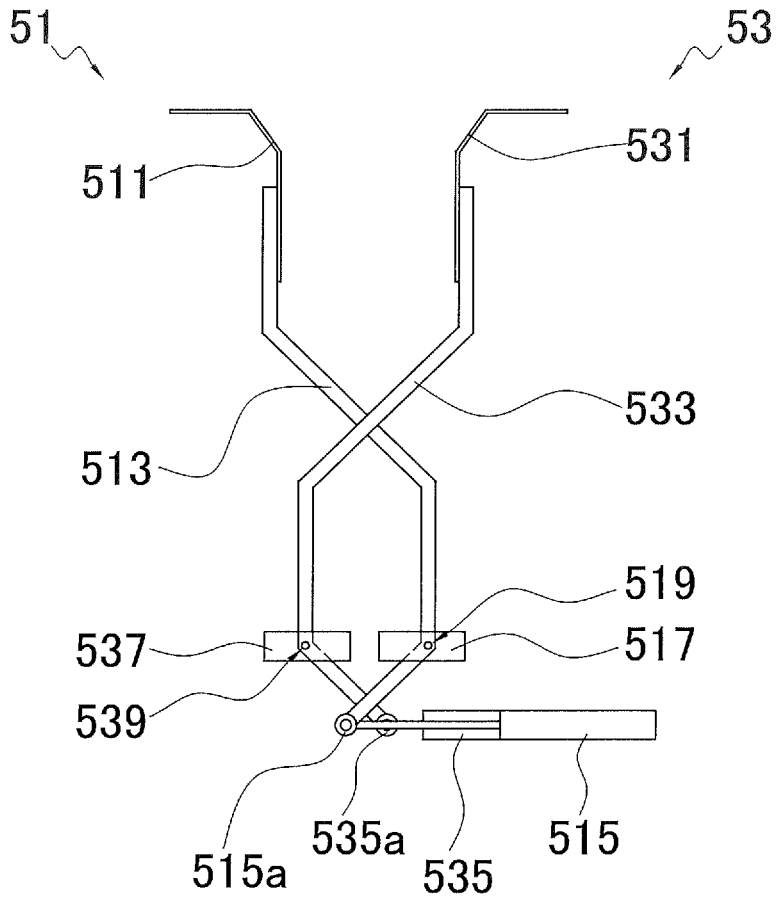
FIG. 11 is a general side view of a first folding mechanism and a third folding mechanism.

As shown in FIG. 11, the other end of the first coupling bar 513 is coupled to the distal end of a piston 515*a* of the first air cylinder 515. A rotational shaft 519 supported by a bearing 517 is coupled to part of the first coupling bar 513. Therefore, when the piston 515*a* reciprocates, the first coupling bar 513 pivots about the rotational shaft 519, so the first folding plate 511 swings in accompaniment therewith.

(5-2-2) Second Folding Mechanism 52

The second folding mechanism 52 includes a pair of second folding plates 521 that are opposite each other and second air cylinders 525 that cause the pair of second folding plates 521 to pivot.

Figure 7:
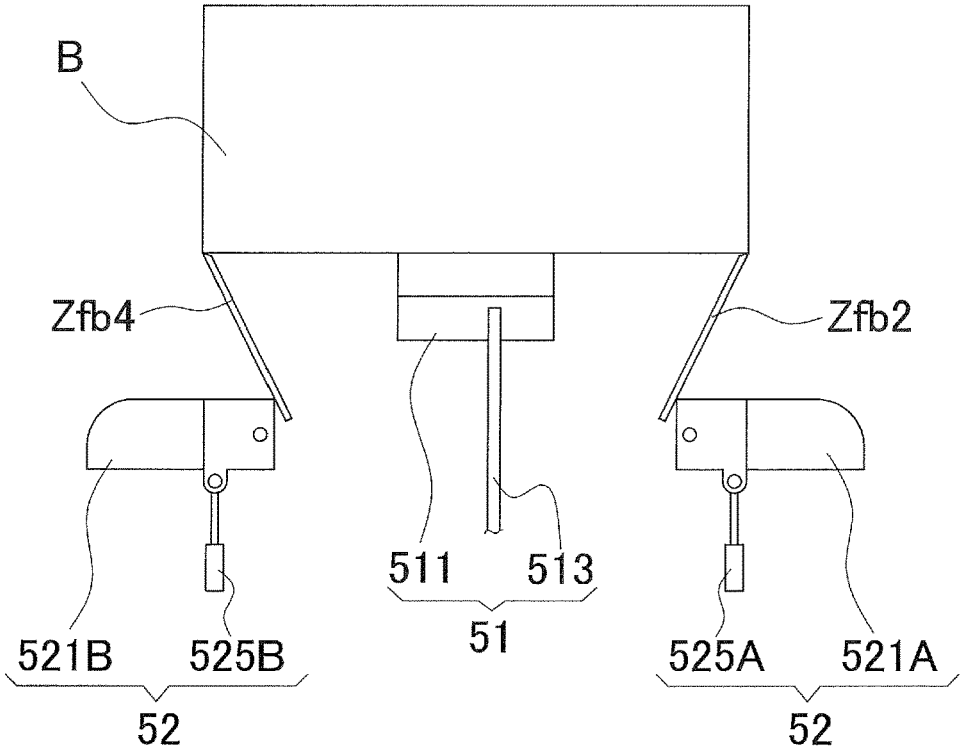
FIG. 7 is a side view of a cardboard box B after a preceding large flap has been folded and just before small flaps are folded.
Figure 8:
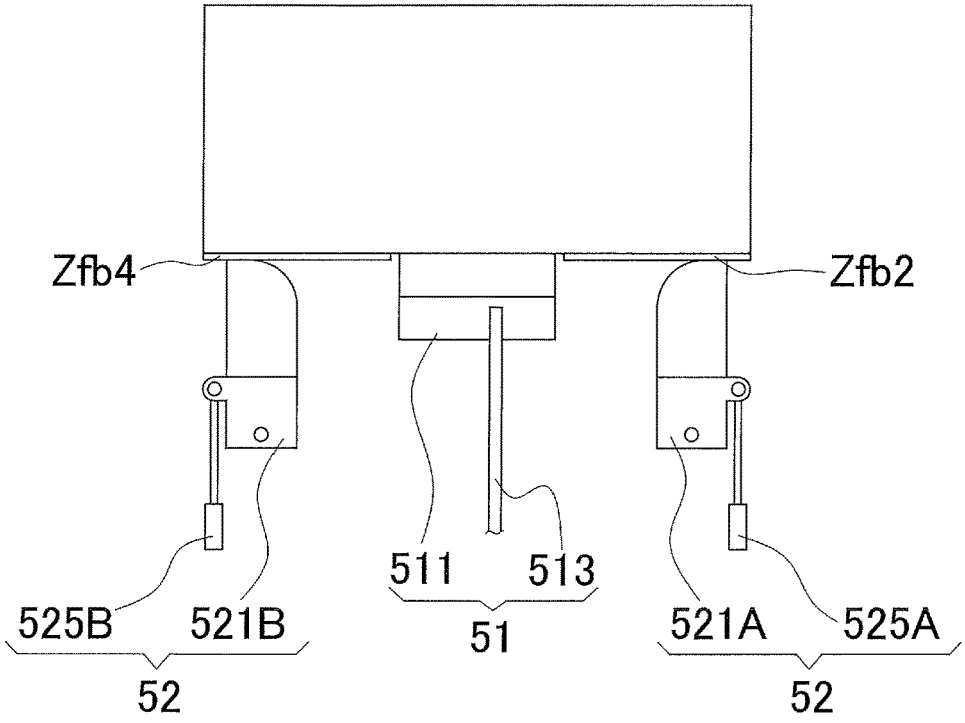
FIG. 8 is a side view of the cardboard box B after the small flaps have been folded.

For convenience of description, the second folding plate 521 on the side that folds the small flap Zfb2 will be called a second folding plate 521A, and the second folding plate 521 on the side that folds the small flap Zfb4 will be called a second folding plate 521B (see FIG. 7 and FIG. 8).

Furthermore, the air cylinder that causes the second folding plate 521A to pivot will be called a second air cylinder 525A, and the air cylinder that causes the second folding plate 521B to pivot will be called a second air cylinder 525B.

The second folding plate 521A is a plate metal member having a quarter arc. A pivot shaft is provided in a position a predetermined distance away from the quarter arc. The distal end of a piston of the second air cylinder 525A is coupled between the quarter arc and the pivot shaft. When the piston of the second air cylinder 525A reciprocates, the second folding plate 521A pivots and the quarter arc folds the small flap Zfb2.

The second folding plate 521B is also a plate metal member having a quarter arc. The second folding plate 521B has the same shape as a mirror image of the second folding plate 521A, and a pivot shaft is provided in a position a predetermined distance away from the quarter arc. The distal end of a piston of the second air cylinder 525B is coupled between the quarter arc and the pivot shaft. When the piston of the second air cylinder 525B reciprocates, the second folding plate 521B pivots and the quarter arc folds the small flap Zfb4.

(5-2-3) Third Folding Mechanism 53

The third folding mechanism 53 is a mechanism that folds the locking large flap Zfb3 and includes a third folding plate 531, a third coupling bar 533, and a third air cylinder 535. In FIG. 4, the positional relationship between the third air cylinder 535 and the third folding plate 531 and third coupling bar 533 cannot be seen, so reference is to be made to FIG. 11, which shows a general side view of the third folding mechanism 53.

(5-2-3-1) Third Folding Plate 531

The third folding plate 531 is a plate metal member having a first surface 531*a*, a second surface 531*b*, and a third surface 531*c*.

The second surface 531*b* extends so as to form an obtuse angle with respect to the first surface 531*a* from the end of the first surface 531*a*. The third surface 531*c* extends perpendicularly with respect to the first surface 531*a* from the end of the second surface 531*b*. Therefore, when the first surface 531*a* is horizontal, the third surface 531*c* is in a vertical posture, and when the first surface 531*a* is vertical, the third surface 531*c* is horizontal.

(5-2-3-2) Third Coupling Bar 533

The third coupling bar 533 is a bar that transmits the displacement of a piston of the third air cylinder 535 to the third folding plate 531.

One end of the third coupling bar 533 is secured to the back surface of the first surface 531*a* of the third folding plate 531. The back surface of the first surface 531*a* is the surface on the opposite side of the surface that contacts the locking large flap Zfb3 when folding the locking large flap Zfb3.

As shown in FIG. 11, the other end of the third coupling bar 533 is coupled to the distal end of a piston 535*a* of the third air cylinder 535. A rotational shaft 539 supported by a bearing 537 is coupled to part of the third coupling bar 533. Therefore, when the piston 535*a* reciprocates, the third coupling bar 533 pivots about the rotational shaft 539, so the third folding plate 531 swings in accompaniment therewith.

The third coupling bar 533 in this embodiment is configured by two bar members, and the two bar members are coupled to each other via the rotational shaft 539.

(5-2-4) Pushing Mechanism 54

As was described in "(5-1) Bottom Flaps Zfb of Cardboard Box B" above, the locking large flap Zfb3 is pushed inside the cardboard box B so that the tongue-like projecting piece Zfb3*a* goes past the recessed cutout Zfb1*a* of the preceding large flap Zfb1, contacts the inside surface of the preceding large flap Zfb1, and stops.

Therefore, the pushing mechanism 54 has pushing rods 541 that push the locking large flap Zfb3 inside the cardboard box B.

(5-2-4-1) Pushing Rods 541

The pushing rods 541 comprise two pushing rods 541*a*, 541*b*. The two pushing rods 541*a*, 541*b* are supported by an upper retention plate 543, a guide plate 544, a middle retention plate 545, and a lower retention plate 546 to maintain an equal distance between themselves.

The above four plate members are disposed in the order of the upper retention plate 543, the guide plate 544, the middle retention plate 545, and the lower retention plate 546 from above. Two through holes through which the two pushing rods 541*a*, 541*b* pass are provided in each of the upper retention plate 543, the guide plate 544, the middle retention plate 545, and the lower retention plate 546.

By aligning the pitches of the two through holes in each of the upper retention plate 543, the guide plate 544, the middle retention plate 545, and the lower retention plate 546, the two pushing rods 541*a*, 541*b* can maintain an equal distance between themselves.

The two pushing rods 541*a*, 541*b* are secured to the two through holes in each of the upper retention plate 543, the middle retention plate 545, and the lower retention plate 546.

The two pushing rods 541*a*, 541*b* are relatively movable with respect to the two through holes in the guide plate 544 as a result of enough clearance to allow the two pushing rods 541*a*, 541*b* to slide therein being provided.

A head 541*c* that directly contacts the locking large flap Zfb3 is supported by the distal ends of the pushing rods 541. The head 541*c* is a plate metal member formed by bending from one metal piece. The cross section of the head 541*c* is L-shaped.

(5-2-4-2) Pushing First Air Cylinder 547

A pushing first air cylinder 547 is disposed in a posture in which its piston 547*a* faces vertically downward. The distal end portion of the piston 547*a* is coupled to the middle retention plate 545. When the piston 547*a* reciprocally moves in the up and down direction, the pushing rods 541 and the head 541*c* move in the up and down direction.

(5-2-4-3) Pushing Second Air Cylinder 549

A pushing second air cylinder 549 is disposed in a posture in which its piston 549*a* faces vertically upward. The distal end portion of the piston 549*a* is coupled to the head 541*c*. Two second pushing rods (not shown in the drawings) with the same pitch as the two pushing rods 541*a*, 541*b* are coupled to the undersurface of the head 541*c*.

The two pushing rods 541*a*, 541*b* are hollow cylinders, and the two second pushing rods have an outer diameter that is slightly smaller than the inner diameter of the hollow cylinders. One of the second pushing rods is inserted inside the hollow cylinder of the pushing rod 541*a*, and the other of the second pushing rods is inserted inside the hollow cylinder of the pushing rod 541*b*.

Therefore, when the piston 549*a* reciprocally moves in the up and down direction, just the head 541*c* moves in the up and down direction.

(5-2-5) Suction Mechanism

The suction mechanism 55 is provided on the upper surface of the head 541*c* of the pushing rods 541. The suction mechanism 55 has at least a suction cup 551. The suction cup 551 sucks hold of the outer surface of the locking large flap Zfb3 when the locking large flap Zfb3 has been pushed inside the cardboard box B, and in the process of the head 541*c* returning to a standby position, the suction cup 551 pulls back the locking large flap Zfb3 from the position to which the locking large flap Zfb3 had been pushed to a position even with the bottom surface of the cardboard box B.

Figure 5:
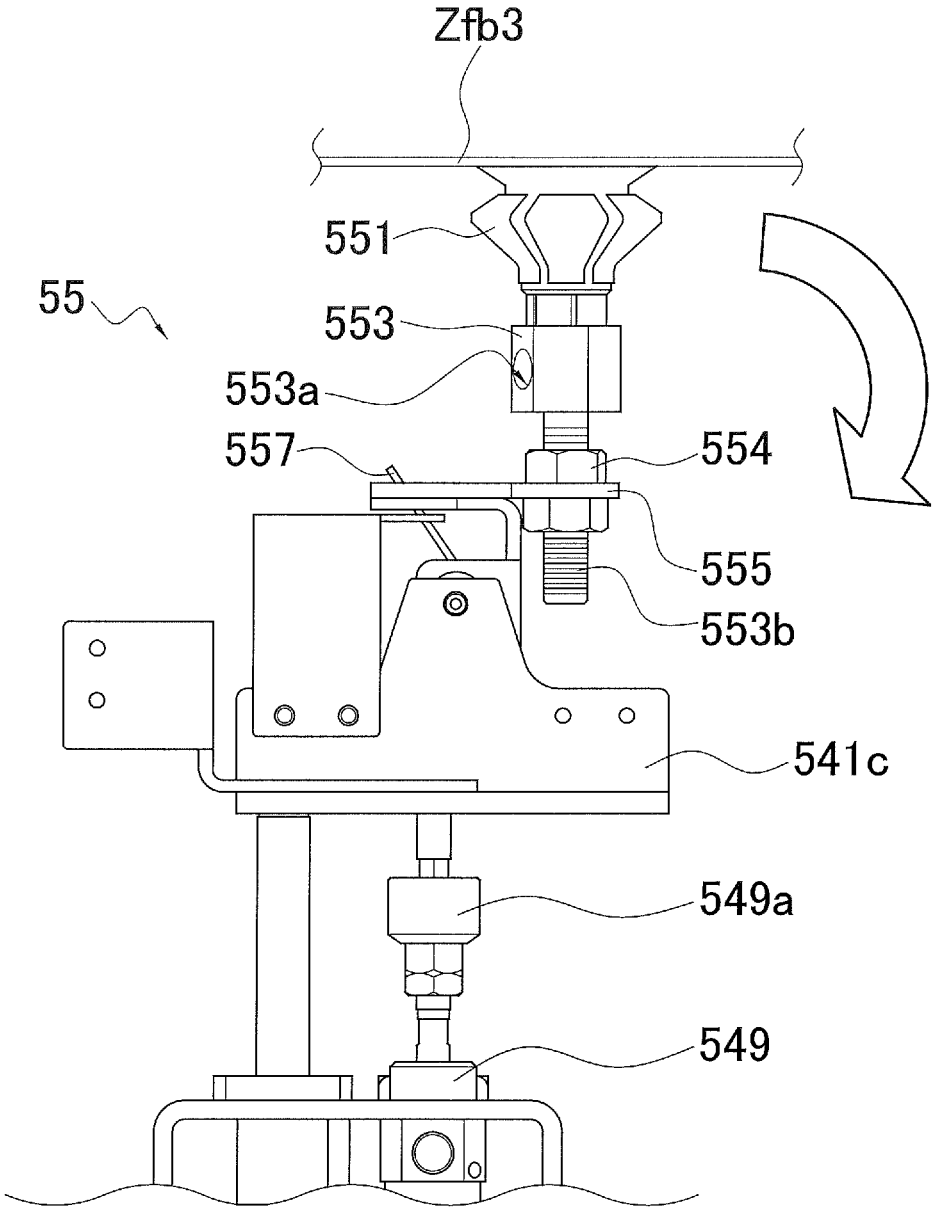
FIG. 5 is a side view of a suction cup just before the suction cup contacts a locking large flap.
Figure 6:
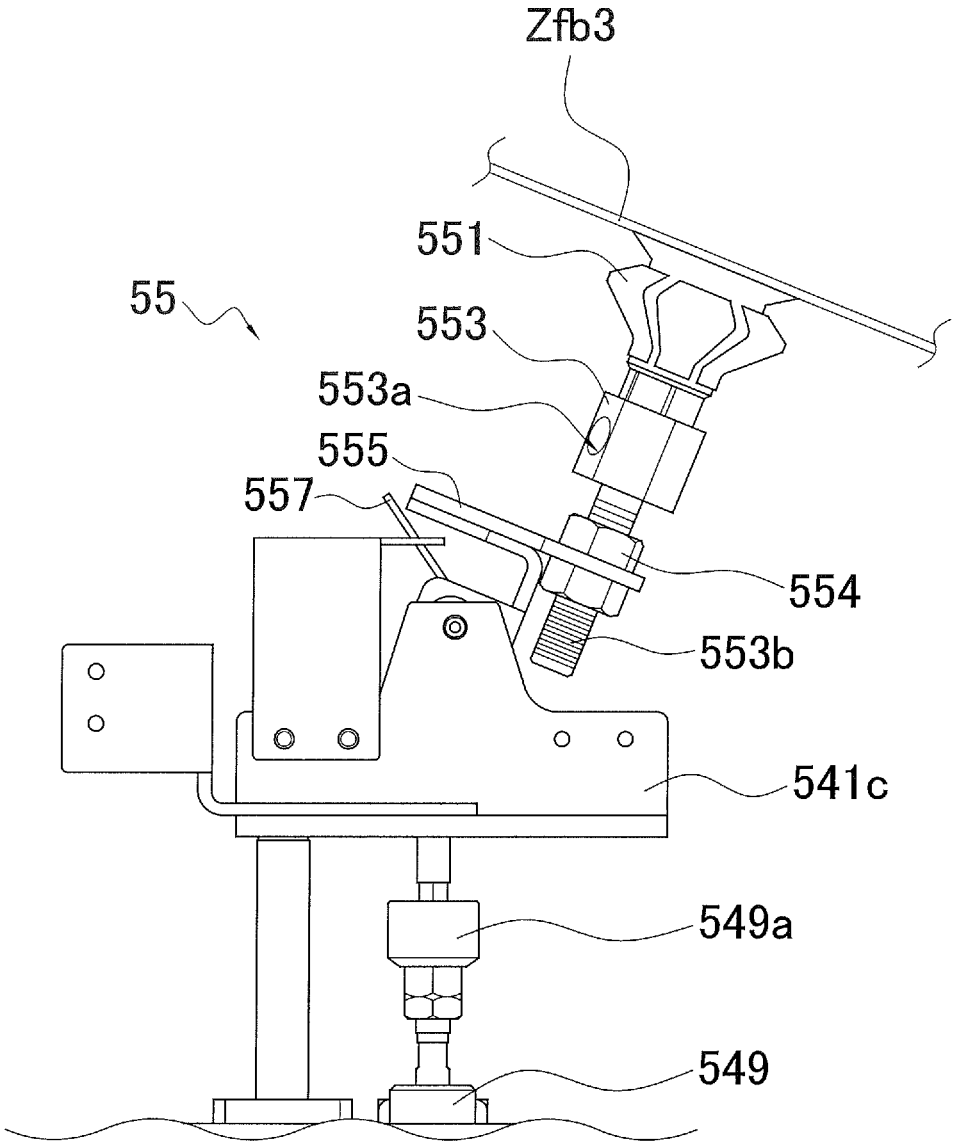
FIG. 6 is a side view of the suction cup when the suction cup has contacted the locking large flap and pushed in the locking large flap.

FIG. 5 is a side view of the suction cup 551 just before the suction cup 551 contacts the locking large flap Zfb3. FIG. 6 is a side view of the suction cup 551 when the suction cup 551 has contacted the locking large flap Zfb3 and pushed in the locking large flap Zfb3.

In FIG. 5, the suction mechanism 55 includes the suction cup 551, a connector 553, a connector retention plate 555, and a posture control spring 557.

The suction cup 551 is a bellows-shaped member formed of silicon rubber, for example. The connector 553 is connected to the suction cup 551 on the opposite side of the suction surface of the suction cup 551. The body portion of the connector 553 is hollow, and a connection hole 553*a* to which a suction tube (not shown in the drawings) is connected is provided in the side surface of the body portion of the connector 553.

The connector 553 is provided with a bolt 553*b* that is a threaded part. The connector 553 is secured to the connector retention plate 555 by the bolt 553*b* and a nut 554.

The connector retention plate 555 is rotatably retained by the head 541*c*. The posture control spring 557 is a torsion coil spring, with one end thereof being caught in the connector retention plate 555 and the other end thereof being caught in the head 541*c*.

The suction cup 551 adopts a posture in which its suction surface faces vertically upward when it stands by. When pushing the locking large flap Zfb3, as shown in FIG. 6, the suction surface of the suction cup 551 inclines to match the change in the angle of inclination of the locking large flap Zfb3. At this time, the angular displacement of the suction surface of the suction cup 551 is transmitted to the connector retention plate 555 via the connector 553, and the connector retention plate 555 becomes angularly displaced counter to the biasing force of the posture control spring 557.

(6) Actions of Case Forming Unit 12

Here, the actions of the case forming unit 12 functioning as the cardboard box erector will be described. First, the actions of the first folding plate 511, the second folding plates 521A, 521B, and the third folding plate 531 will be described with reference to FIG. 7 and FIG. 8.

FIG. 7 is a side view of the cardboard box B after the preceding large flap Zfb1 has been folded and just before the small flaps Zfb2, Zfb4 are folded. FIG. 8 is a side view of the cardboard box B after the small flaps Zfb2, Zfb4 have been folded.

In FIG. 7, the first folding plate 511 has already folded the preceding large flap Zfb1 and is standing by. At this time, the set of small flaps Zfb2, Zfb4 are waiting to be folded by the second folding plates 521A, 521B.

Next, in FIG. 8, the pistons of the second air cylinders 525A, 525B ascend and cause the second folding plates 521A, 521B to pivot about 90°, whereby the small flaps Zfb2, Zfb4 are folded.

Next, the actions of folding the locking large flap Zfb3 will be described with reference to FIG. 9 and FIG. 10.

Figure 9:
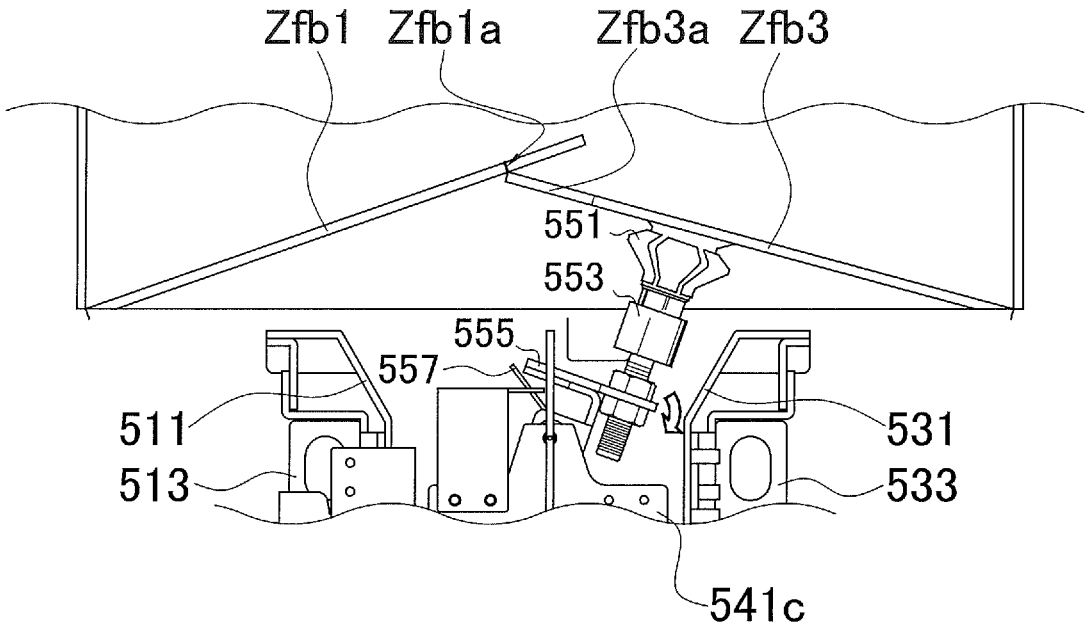
FIG. 9 is a front view of the cardboard box B when a third folding plate has folded the locking large flap and a head has ascended.

FIG. 9 is a front view of the cardboard box B when the third folding plate 531 has folded the locking large flap Zfb3 and the head 541*c* has ascended. FIG. 10 is a front view of the cardboard box B when the head 541*c* has descended.

In FIG. 9, as a result of the head 541*c* having ascended, the suction cup 551 pushes the locking large flap Zfb3 inside the cardboard box B, and the locking large flap Zfb3 pivots about its base and inclines.

The locking large flap Zfb3 is pushed until the projecting piece Zfb3*a* of the locking large flap Zfb3 goes past the cutout Zfb1*a* of the preceding large flap Zfb1 and rides up onto the inside surface of the preceding large flap Zfb1.

At this time, the suction surface of the suction cup 551 inclines to match the change in the angle of inclination of the locking large flap Zfb3. The angular displacement of the suction surface of the suction cup 551 is transmitted via the connector 553 to the connector retention plate 555, and the connector retention plate 555 becomes angularly displaced counter to the biasing force of the posture control spring 557.

After the locking large flap Zfb3 has been pushed until the projecting piece Zfb3*a* of the locking large flap Zfb3 rides up onto the inside surface of the preceding large flap Zfb1, the head 541*c* descends.

Figure 10:
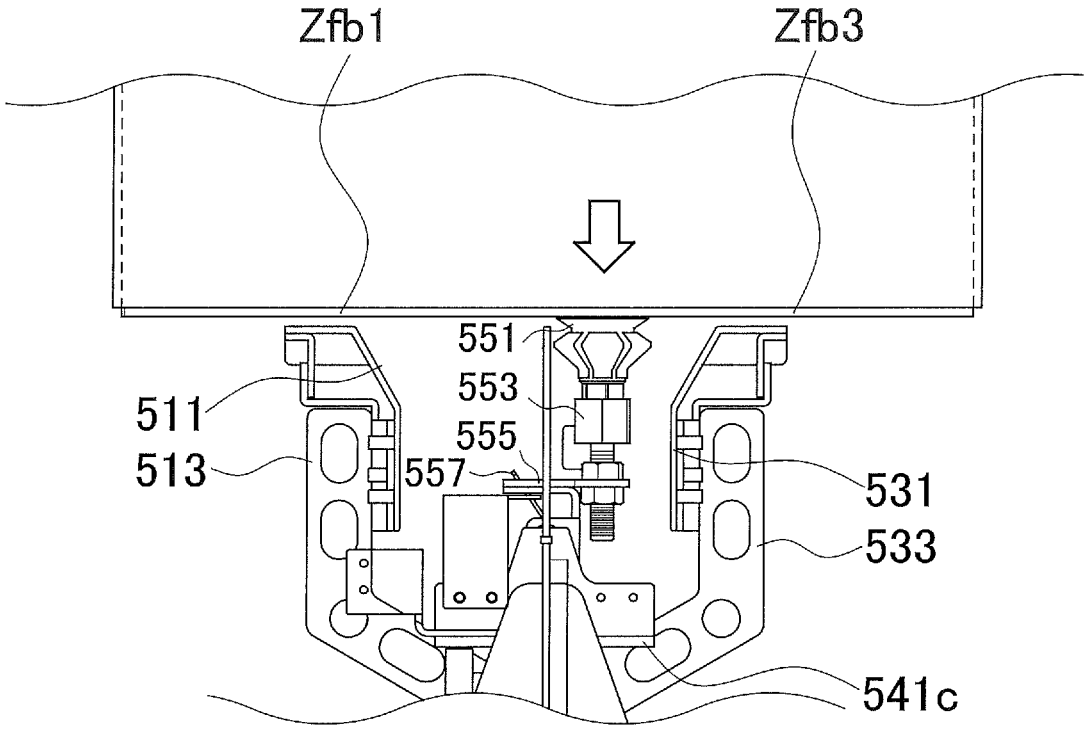
FIG. 10 is a front view of the cardboard box when the head has descended.

FIG. 10 is a front view of the cardboard box B when the head 541*c* has descended and the locking large flap Zfb3 has been returned to the original level of the bottom surface. In FIG. 10, in accompaniment with the descent of the head 541*c*, the suction cup 551 also descends. The suction cup 551 descends in a state in which it is sucking hold of the outer surface of the locking large flap Zfb3, so the locking large flap Zfb3 is pulled back to the height position of the bottom surface of the cardboard box B without staying inside the cardboard box B.

The projecting piece Zfb3*a* of the locking large flap Zfb3 goes past the cutout Zfb1*a* of the preceding large flap Zfb1 and rides up onto the inside surface of the preceding large flap Zfb1 at the stage before the locking large flap Zfb3 is pulled back to the height position of the bottom surface of the cardboard box B, and the locking large flap Zfb3 descends so as to press down the preceding large flap Zfb1, so they descend to the height position of the bottom surface in the order of the preceding large flap Zfb1 and the locking large flap Zfb3.

Because of the above actions, the preceding large flap Zfb1, the locking large flap Zfb3, and the pair of small flaps Zfb2 and Zfb4 interfere with each other, and the bottom of the cardboard box B is finished.

When the locking large flap Zfb3 also descends, it pivots about its base, so the locking large flap Zfb3 descends while changing its angle of inclination, but the change in the angle of inclination of the suction surface of the suction cup 551 is transmitted via the connector 553 to the connector retention plate 555. The connector retention plate 555 is biased by the posture control spring 557, so it can follow the change in the angle of inclination of the suction surface of the suction cup 551.

Consequently, the suction surface of the suction cup 551 can follow the change in the angle of inclination of the locking large flap Zfb3 and can maintain reliable suction.

The suction by the suction cup 551 is cancelled at the timing when the suction surface of the suction cup 551 reaches the height position of the bottom surface of the cardboard box B, and the head 541*c* descends further and the suction cup 551 separates from the locking large flap Zfb3.

(7) Characteristics (7-1)

The head 541*c* performs an action wherein it pushes, deep inside the cardboard box B, the locking large flap Zfb3 folded last out of the four flaps and goes back. At this time, the suction cup 551 that moves in conjunction with the head 541*c* sucks and holds the locking large flap Zfb3, so when the head 541*c* goes back, the suction cup 551 can pull back the locking large flap Zfb3 to the bottom (the open surface).

(7-2)

The pushing mechanism 54 is secured to part of the third folding mechanism 53 that folds the locking large flap Zfb3. As a result, it suffices for the pushing mechanism 54 to start the pushing action from a predetermined position of the third folding mechanism that is in a position near the locking large flap Zfb3, so the push stroke can be shortened.

(7-3)

The locking large flap Zfb3 that is pushed pivots about its base (the edge of the opening) as a central axis, so its posture changes in such a way that its angle of inclination increases in accordance with the distance it is pushed, but the suction cup 551 is pivotably retained by the head 541*c*, and the suction surface of the suction cup 551 follows the change in the angle of inclination of the locking large flap Zfb3, so the suction cup 551 can maintain stable suction even when the locking large flap Zfb3 inclines.

(8) Other

Types of forming the bottom of the cardboard box B include the locking bottom type such as in this application and the conventional taped type. Realizing a case forming unit that can be used for both is ideal, but the order in which the bottom flaps are folded and the lengths of the bottom flaps are different, so it is necessary to prevent interference between the bottom flaps and the folding mechanisms through changing the arrangement of the folding mechanisms and adjusting the folding timings.

Furthermore, the locking bottom type such as in this application needs to have the locking large flap pushed in last and needs to be configured to not interfere with the pushing mechanism when the sheet-like cardboard box precursor is opened and conveyed to the folding mechanisms.

It is also conceivable to provide the pushing mechanism outside the conveyance region, but the push stroke becomes longer and the region for avoiding interference with other mechanisms becomes larger, which runs counter to making the device compact.

Furthermore, with a locking bottom type, the bottom flaps of the cardboard box support each other, so after forming the bottom, a mechanism that supports the bottom when conveying the cardboard box is unnecessary, but with a taped type, it is necessary to support the bottom, so it is necessary to convey the cardboard box to the taping region in a state in which the folding mechanisms support the bottom.

To solve this problem, in the embodiment pertaining to this invention, as shown in FIG. 7 to FIG. 10, the first folding plate 511, the second folding plates 521A, 521B, and the third folding plate 531 have structures and arrangements that do not interfere with each other even while they retain the corresponding bottom flaps Zfb.

Therefore, it is not necessary to superimpose the action timings of the first folding mechanism 51, the second folding mechanism 52, and the third folding mechanism 53, and taped type and locking bottom type cardboard boxes can be erected using the same mechanisms.

REFERENCE SIGNS LIST

12 Case Forming Unit (Cardboard Box Erector)
51 First Folding Mechanism (First Folding Unit)
52 Second Folding Mechanism (Second Folding Unit)
53 Third Folding Mechanism (Third Folding Unit)
54 Pushing Mechanism (Pushing Unit)
541 Pushing Rods (Pushing Unit)
541*a* Pushing Rod (Pushing Unit)
541*b* Pushing Rod (Pushing Unit)
541*c* Head (Pushing Unit)
55 Suction Mechanism (Suction Unit)
551 Suction Cup (Suction Unit)
553 Connector (Suction Unit)
555 Connector Retention Plate (Suction Unit)
557 Posture Control Spring (Suction Unit)
B Cardboard Box
Zfb1 Preceding Large Flap
Zfb2 Small Flap
Zfb3 Locking Large Flap (Locking Flap)
Zfb4 Small Flap

What is claimed is:

1. A cardboard box erector that folds four flaps provided on edges of an opening of a cardboard box, the four flaps surrounding the opening, the cardboard box erector comprising:

a folding unit configured to fold each of the four flaps in a predetermined order to close the opening, the four flaps including a locking flap folded last among the four flaps; and a pushing unit configured to perform an action to push the locking flap inside the cardboard box and pull the locking flap back, wherein the pushing unit has a suction unit configured to suck and hold the locking flap during the action of the pushing unit.

2. The cardboard box erector according to claim 1, wherein the pushing unit is secured to part of the folding unit.

3. The cardboard box erector according to claim 2, wherein the four flaps include a set of small flaps opposite each other and a set of large flaps opposite each other, with one of the set of large flaps being the locking flap, the folding unit has a first folding unit configured to hold the large flap, opposite the locking flap, of the set of large flaps, a second folding unit configured to hold the set of small flaps, and a third folding unit configured to hold the locking flap, and the pushing unit is secured to the third folding unit.

4. The cardboard box erector according to claim 1, wherein the suction unit allows a posture of a suction surface thereof that sucks the locking flap to follow changes in a posture of the locking flap.

5. The cardboard box erector according to claim 4, wherein the suction unit is pivotably retained by the pushing unit.

* * * * *